US009483979B2

(12) United States Patent
Yang

(10) Patent No.: US 9,483,979 B2
(45) Date of Patent: Nov. 1, 2016

(54) PIXEL CIRCUIT, DRIVING METHOD THEREOF, AND DISPLAY DEVICE

(71) Applicant: BEIJING BOE OPTOELECTRONICS TECHNOLOGY CO., LTD, Beijing (CN)

(72) Inventor: Shengji Yang, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 366 days.

(21) Appl. No.: 14/132,614

(22) Filed: Dec. 18, 2013

(65) Prior Publication Data

US 2014/0175992 A1 Jun. 26, 2014

(30) Foreign Application Priority Data

Dec. 21, 2012 (CN) ..... 2012 1 0564742

(51) Int. Cl.
*H05B 37/00* (2006.01)
*G09G 3/32* (2016.01)

(52) U.S. Cl.
CPC .... *G09G 3/3233* (2013.01); *G09G 2300/0819* (2013.01); *G09G 2300/0861* (2013.01); *G09G 2310/0251* (2013.01); *G09G 2310/0262* (2013.01)

(58) Field of Classification Search
CPC ..... H05B 37/00
See application file for complete search history.

(56) References Cited

U.S. PATENT DOCUMENTS 8,378,930 B2 * 2/2013 Asano ..... G09G 3/3233 345/76
9,111,486 B2 * 8/2015 Choi ..... G09G 3/3225 315/169.3
2012/0147060 A1 6/2012 Jeong

FOREIGN PATENT DOCUMENTS

CN 102568374 A 7/2012
CN 202976780 U 6/2013

OTHER PUBLICATIONS

Chinese Rejection Decision Appln. No. 201210564742.8; Issued Aug. 6, 2014.
First Chinese Office Action dated May 23, 2014; Appln. No. 201210564742.8.

* cited by examiner

*Primary Examiner* — Hai L Nguyen
(74) *Attorney, Agent, or Firm* — Ladas & Parry LLP

(57) ABSTRACT

Provided are a pixel circuit, a driving method thereof, and a display device, which relate to the field of the display technology and can effectively compensate variation in currents due to ununiformity and drift of threshold voltages of driving Thin Film Transistors as well as ununiformity of OLEDs. The pixel circuit comprises: a light-emitting element; a driving TFT; a first TFT having a drain connected to a gate of the driving TFT; a second TFT having a drain connected to a source of the driving TFT; a third TFT having a source connected to a drain of the driving TFT, and a drain connected to the light-emitting element; a fourth TFT having a source connected to the gate of the driving TFT, and a drain connected to the drain of the driving TFT; a fifth TFT having a drain connected to the source of the driving TFT; and a capacitor.

10 Claims, 2 Drawing Sheets

PIXEL CIRCUIT, DRIVING METHOD THEREOF, AND DISPLAY DEVICE

TECHNICAL FIELD

The present disclosure relates to a field of display technology, in particular to a pixel circuit, a driving method thereof, and a display device.

BACKGROUND

An Organic Light Emitting Diode (OLED) is a current-driven self-luminous type device, and for its unique characteristics such as self-illumination, fast response, wide viewing angle and the capability of being manufactured on a flexible substrate, an organic light-emitting display device based on the OLED is expected to become the mainstream in the field of display technology in the next years.

Each of display units on an organic light-emitting display device comprises an OLED, and the organic light-emitting display device can be divided into an active organic light-emitting display device and a passive organic light-emitting display device, wherein the active organic light-emitting display device refers to a display device in which, for each OLED, the current flowing through the OLED is controlled by a Thin Film Transistor (TFT) circuit, and the OLED and the TFT circuit for controlling the OLED constitute a pixel circuit.

A typical pixel circuit is illustrated in FIG. 1 and the pixel circuit comprises 2 TFTs, 1 capacitor and 1 OLED, wherein a switch transistor T2 transmits a data voltage on a data line to a gate of a driving transistor T1, and the driving transistor T1 converts the data voltage to a corresponding current for supplying to the OLED, wherein the current can be represented as follows:

$$I_{OLED} = \frac{1}{2}\mu_n \cdot Cox \cdot \frac{W}{L} \cdot (Vgs - Vth)^2 = \frac{1}{2}\mu_n \cdot Cox \cdot \frac{W}{L} \cdot (Vdata - Voled - Vth)^2 \quad (1)$$

wherein $V_{gs}$ represents a potential difference between the gate and a source of the driving transistor T1, $\mu_n$ represents a carrier mobility, Cox represents a capacitance of gate-insulating layer, W/L represents a ratio of width to length of channel of the driving transistor T1, $V_{data}$ represents the data voltage, $V_{oled}$ represents an operating voltage of the OLED, and $V_{th}$ represents a threshold voltage of the driving transistor T1. It can seen from the above equation that there is variation in currents flowing through the OLEDs if $V_{th}$ varies in different pixel units or $V_{th}$ drifts with time, thus affecting the display effect; further, the OLEDs have different operating voltages due to the ununiformity of OLEDs, which in turn results in variation in currents flowing through the OLEDs.

SUMMARY

In embodiments of the present disclosure, there is provided a pixel circuit, a driving method thereof, and a display device, which can effectively compensate variation in currents due to the ununiformity and drifts in the threshold voltages of the driving Thin Film Transistors as well as the ununiformity of OLEDs, thus enhancing display quality of the display device.

According to one aspect of the present disclosure, there is provided a pixel circuit comprising:

a light-emitting element;

a driving Thin Film Transistor (TFT) for driving the light-emitting element;

a first TFT having a source connected to a reference voltage terminal, a drain connected to a gate of the driving TFT, and a gate for receiving a first control signal;

a second TFT having a gate for receiving a first scan signal, a drain connected to a source of the driving TFT, and a source for receiving a data voltage signal;

a third TFT having a gate for receiving a second scan signal, a source connected to a drain of the driving TFT, and a drain connected to the light-emitting element;

a fourth TFT having a gate for receiving the first scan signal, a source connected to the gate of the driving TFT, and a drain connected to the drain of the driving TFT;

a fifth TFT having a gate for receiving the second scan signal, a source connected to a power supply voltage terminal, and a drain connected to the source of the driving TFT;

a capacitor having one terminal connected to a first node A, and the other terminal connected to a second node B, wherein the first node A is a connection point where the drain of the first TFT and the gate of the driving TFT are connected, and the second node B is connected to the reference voltage terminal.

Optionally, the first, second, third, fourth, and fifth TFTs and the driving transistor are all P type Thin Film Transistors.

Optionally, the light-emitting element is an Organic Light-Emitting Diode.

According to another aspect of the present disclosure, there is further provided a display device having any of the pixel circuits described as above arranged therein.

According to still another aspect of the present disclosure, there is further provided a driving method applicable to the pixel circuit as above comprising:

in a resetting phase, turning on the first TFT under a control of a first control signal, discharging electric charges stored at the first node A via the first TFT, resetting a voltage signal at the gate of the driving TFT so as turn on the driving TFT, and turning off the second TFT, the third TFT, the fourth TFT and the fifth TFT;

in a compensating phase, turning on the second TFT and the fourth TFT under a control of a first scan signal, making the driving TFT continue to be turned on, wherein since the fourth TFT is turned on, the gate and the drain of the driving TFT are connected electrically; charging the first node A by a data signal via the driving TFT, so that a voltage at the node A rises; and turning off the first TFT, the third TFT and the fifth TFT; and in a maintaining light-emission phase, turning on the third TFT and the fifth TFT under a control of the second scan signal, keeping the voltage at the gate of the driving TFT unchanged by the capacitor, and making the driving TFT continue to be turned on, and driving the OLED to emit light by a power supply voltage; and turning off the first TFT, the second TFT and the fourth TFT.

In the pixel circuit, the driving method thereof and the display device provided in the embodiments of the present disclosure, one terminal of the capacitor is connected to the gate of the driving TFT (the first node), and the other terminal of the capacitor is connected to the reference voltage terminal; the fifth TFT is controlled so that the source of the driving TFT receives the power supply voltage, and the third TFT is controlled so that the drain of the driving TFT is connected to the light-emitting element. The process for displaying each frame of image includes three phases, i.e., the resetting phase, the compensating phase, and the maintaining light-emission phase. In the resetting phase, the first TFT is turned on, the electric charges stored at the first node is discharged, so that the voltage at the first node is pulled down and thus the driving TFT is turned on; in the compensating phase, the second and fourth TFTs are turned on, and the gate and the source or drain of the driving TFT are connected electrically, so that the voltage at the first node contains information on the threshold voltage of the driving TFT; in the maintaining light-emission phase, the third and fifth TFTs are turned on, the voltage at the gate of the driving TFT remains unchanged, and the power supply signal drives the light-emitting element to emit light, wherein the current through the light-emitting element is independent of the threshold voltage of the driving TFT and the voltage across the light-emitting element. Thus, variation in currents due to the ununiformity and drift of the threshold voltages of the driving TFTs as well as the ununiformity of OLEDs can be compensated effectively, thus enhancing the display quality of the display device; at the same time, TFTs of the same type are adopted in the pixel circuit so as to not only ensure that no current flows through the OLED during all the non-light-emission periods, but also improve a life span of the OLED.

BRIEF DESCRIPTION OF THE DRAWINGS

In following description, the features and advantages of the embodiments of the present disclosure will be more apparent in connection with the accompanying drawings. In the whole drawings, the same content is denoted with the same reference number, wherein.

DETAILED DESCRIPTION OF EMBODIMENTS

In embodiments of the present disclosure, there is provided a pixel circuit, a driving method thereof, and a display device, which can effectively compensate variation in currents due to the ununiformity and drift of the threshold voltages of driving Thin Film Transistors as well as the ununiformity in OLEDs, thus enhancing the display quality of the display device; at the same time, TFTs of a same type are adopted in the pixel circuit so as to not only ensure that no current flows through the OLED during all the non-light-emission periods, but also improve the life span of the OLED.

Hereinafter, the embodiments of the present disclosure will be described in detail with reference to the accompanying drawings. The specific embodiments as described herein are only for illustrating some aspects of the present disclosure, and are not intended to limit the protection scope of the present disclosure in any way.

It should be noted that there is no clear distinction between a drain and a source of a transistor used in the field of Liquid Crystal Display technology, and thus a source of a transistor described in the embodiments of the present disclosure can serve as a drain of the transistor, and a drain of a transistor described in the embodiments of the present disclosure can serve as a source of the transistor.

Figure 1:
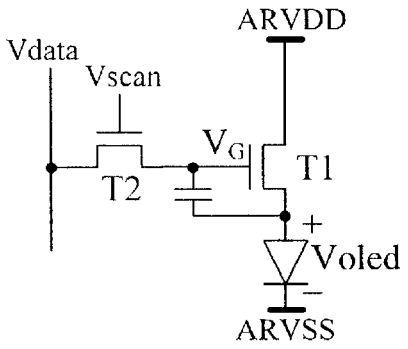
FIG. 1 is a schematic diagram showing a structure of a pixel circuit in the prior art.
Figure 2:
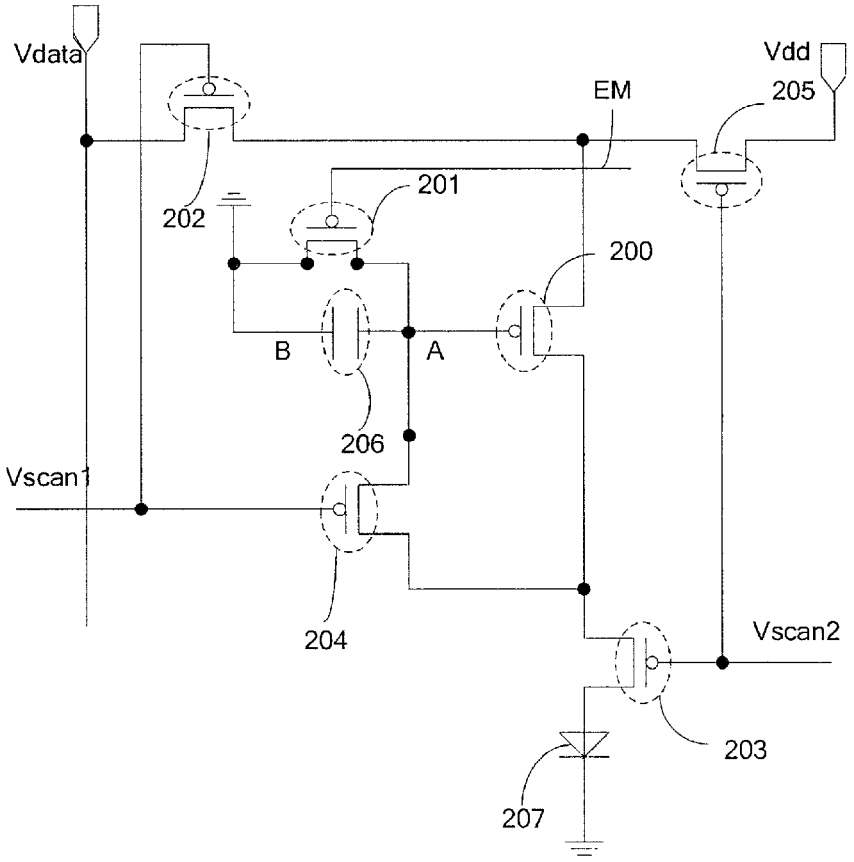
FIG. 2 is a schematic diagram showing a pixel circuit provided in an embodiment of the present disclosure.

A pixel circuit provided in an embodiment of the present disclosure is as shown in FIG. 2 and comprises:

a light-emitting element 207;

a driving Thin Film Transistor (TFT) 200 for driving the light-emitting element 207;

a first TFT 201 having a source connected to a reference voltage terminal, a drain connected to a gate of the driving TFT 200, and a gate for receiving a first control signal EM;

a second TFT 202 having a gate for receiving a first scan signal Vscan1, a drain connected to a source of the driving TFT 200, and a source for receiving a data voltage signal $V_{data}$;

a third TFT 203 having a gate for receiving a second scan signal Vscan2, a source connected to a drain of the driving TFT 200, and a drain connected to the light-emitting element;

a fourth TFT 204 having a source connected to the gate of the driving TFT 200, a drain connected to the drain of the driving TFT 200, and a gate for receiving the first scan signal Vscan1;

a fifth TFT 205 having a gate for receiving the second scan signal Vscan2, a source connected to a power supply voltage terminal for receiving a power supply voltage $V_{dd}$, and a drain connected to the source of the driving TFT 200;

a capacitor 206 having one terminal connected to a first node A, and the other terminal connected to a second node B, wherein the first node A is a connection point where the drain of the first TFT 201 and the gate of the driving TFT 200 are connected, and the second node B is connected to the reference voltage terminal.

The above pixel circuit comprises 5 TFTs and 1 capacitor, wherein the 5 TFTs (T1~T5) are all P type TFTs for facilitating manufacture. Preferably, except the driving TFT, all TFTs adopt P type TFTs having a same structure and a same size. Optionally, the light-emitting element 207 is an Organic Light-Emitting Diode (OLED).

The pixel circuit provided in the embodiment of the present disclosure can effectively compensate variation in currents due to the ununiformity and drift of the threshold voltages of the driving TFTs as well as the ununiformity of OLEDs (the details of the operational principle are as follows), thus enhancing the display quality of the display device; at the same time, TFTs of the same type are adopted in the pixel circuit so as to not only ensure that no current flows through the OLED during all the non-light-emission periods, but also improve the life span of the OLED.

Figure 3:
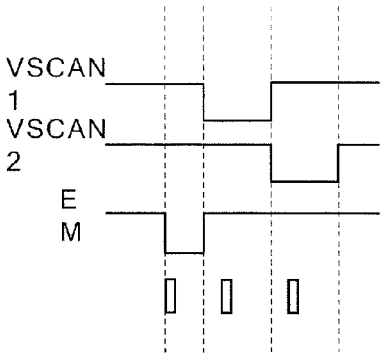
FIG. 3 is a timing control diagram of the pixel circuit in an embodiment of the present disclosure.
Figure 4:
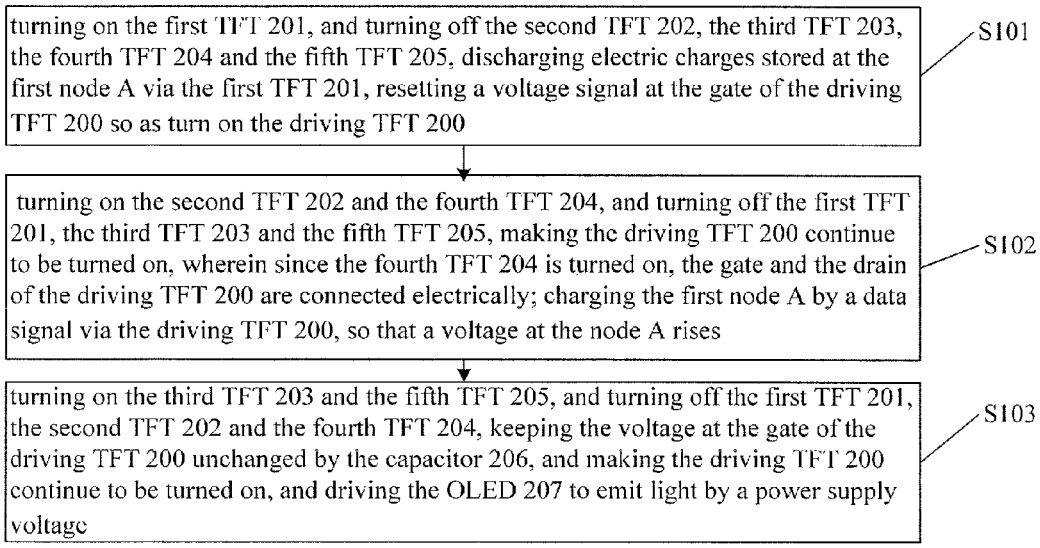
FIG. 4 is a flowchart of a driving method of the pixel circuit in an embodiment of the present disclosure.

Transistors employed in the pixel circuit shown in FIG. 2 are all P type TFTs, and a timing control of the pixel circuit is illustrated schematically in FIG. 3, wherein the process for displaying each frame of image includes three phases of resetting (I), compensating (II) and maintaining light-emission (III), and as shown in FIG. 3, particularly comprises the following steps or phases.

In step 101, i.e., in a resetting phase (I), a first scan signal Vscan1 and a second scan signal Vscan2 are at a high level, and a first control signal EM is at a low level, so that the first TFT 201 is turned on under a control of the first control signal EM, electric charges stored at the first node A are discharged via the first TFT 201, a voltage signal at the gate of the driving TFT 200 is reset and the driving TFT 200 is turned on, and the second TFT 202, the third TFT 203, the fourth TFT 204 and the fifth TFT 205 are turned off under the control of the first scan signal Vscan1 and the second scan signal Vscan2.

In summary, in the resetting phase (I), among the five P type TFTs, except that the first TFT 201 is turned on, other TFTs in five P type TFTs, i.e., TFTs 202-205 are turned off, the electric charges stored at the first node A are discharged via the first TFT 201, the voltage signal at the gate of the driving TFT 200 is reset and the driving TFT 200 is turned on.

In step 102, i.e., in a compensating phase(II), the first scan signal Vscan1 is at a low level, the second scan signal Vscan2 is at a high level, and the first control signal EM is at a high level, so that the second TFT 202 and the fourth TFT 204 are turned on under a control of the first scan signal Vscan1, the driving TFT 200 continues to be turned on; since the fourth TFT 204 is turned on, the gate and the drain of the driving TFT 200 are connected electrically, the first node A is charged by a data signal $V_{data}$ via the driving TFT 200, so that the voltage at the node A rises; the first TFT 201, the third TFT 203 and the fifth TFT 205 are turned off under the control of the second scan signal Vscan 2 and the first control signal EM.

In summary, in the compensating phase (II), the second TFT 202 and the fourth TFT 204 are turned on, the first TFT 201, the third TFT 203 and the fifth TFT 205 are turned off, and the driving TFT 200 continues to be turned on; since the fourth TFT 204 is turned on, the gate and the drain of the driving TFT 200 are connected electrically, the first node A is charged by the data signal $V_{data}$ via the driving TFT 200, so that the voltage at the node A rises until the voltage at the node A is equal to $V_{data}-V_{th}$. At the end of the compensating phase (II), the quantity of the electric charges Q on the capacitor 206 is equal to:

$$Q=C\,(V_2-V_1)=C\cdot(V_{REF}+V_{th}-V_{data}) \tag{2}$$

wherein, $V_1$ represents the voltage at the first node A at this time, and is equal to $V_{data}-V_{th}$; $V_2$ represents the voltage at the second node B at this time, and is equal to the voltage $V_{REF}$ at the reference voltage terminal; in the embodiments of the present disclosure, the reference voltage terminal is grounded, and the voltage $V_{REF}$ is equal to 0.

In step 103, i.e., in a maintaining light-emission phase (III), the first scan signal Vscan1 is at a high level, the second scan signal Vscan2 is at a low level, and the first control signal EM is at a high level, so that the third TFT 203 and the fifth TFT 205 are turned on under a control of the second scan signal Vscan2; the capacitor 206 keeps the voltage at the gate of the driving TFT 200 unchanged, and the driving TFT 200 continues to be turned on, and the OLED is driven to emit light by a power supply voltage $V_{dd}$; the first TFT 201, the second TFT 202 and the fourth TFT 204 are turned off under the control of the first scan signal Vscan 1 and the first control signal EM.

In summary, in the maintaining light-emission phase, the third TFT 203 and the fifth TFT 205 are turned on, the first TFT 201, the second TFT 202 and the fourth TFT 204 are turned off; the capacitor 206 keeps the voltage at the gate of the driving TFT 200 still equal to $V_{data}-V_{th}$, and the voltage at the source of the driving TFT 200 is equal to the power supply voltage $V_{dd}$; in order to ensure that the driving TFT 200 is turned on during the maintaining light-emission phase, the power supply voltage $V_{dd}$ is designed to be less than the data signal voltage $V_{data}$, and the OLED is driven to emit light by the power supply voltage $V_{dd}$.

$$V_{gs}=V_s-V_g=V_{dd}+V_{th}-V_{data} \tag{3}$$

The gate-source voltage of the driving TFT 200 remains at $V_{dd}+V_{th}-V_{data}$, and at this time the current through the driving TFT 200 is as follows:

$$\begin{aligned} I_{OLED} &= \frac{1}{2}\cdot\mu_n\cdot Cox\cdot\frac{W}{L}\cdot[V_{dd}-V_{data}+V_{th}-V_{th}]^2 \\ &= \frac{1}{2}\cdot\mu_n\cdot Cox\cdot\frac{W}{L}\cdot[V_{dd}-V_{data}]^2 \end{aligned} \tag{4}$$

It can be known from the above equation that the current through the driving TFT 200 has a relation to the power supply voltage $V_{dd}$ and the data voltage $V_{data}$, and is independent of the threshold voltage $V_{th}$. Thus, the effects of the ununiformity and drift of the threshold voltages of the driving TFTs as well as the ununiformity of the electrical characteristics of the OLEDs can be eliminated.

According to the embodiments of the present disclosure, there is further provided a display device having any of the pixel circuits described as above arranged therein. Since the pixel circuit can effectively compensate variation in currents due to the ununiformity and drift of the threshold voltages of the driving TFTs as well as the ununiformity of OLEDs, the display device provide in the embodiment of the present disclosure have advantages such as uniform brightness and better display quality.

The display device can be an OLED panel, a mobile phone, a tablet computer, a television set, a display, a notebook computer, a digital photo frame, a navigator, and any product or means having a display function.

The technical features in the embodiments of the present disclosure can be combined with each other in any way in a case where there is no confliction therebetween.

The above descriptions are only for illustrating the embodiments of the present disclosure, and in no way limit the scope of the present disclosure. It will be obvious that those skilled in the art may make modifications, variations and equivalences to the above embodiments without departing from the spirit and scope of the present disclosure as defined by the following claims. Such variations and modifications are intended to be included within the spirit and scope of the present disclosure.

What is claimed is:

1. A pixel circuit comprising:

a light-emitting element;

a driving Thin Film Transistor (TFT) for driving the light-emitting element;

a first TFT having a source connected to a reference voltage terminal, a drain connected to a gate of the driving TFT, and a gate for receiving a first control signal;

a second TFT having a gate for receiving a first scan signal, a drain connected to a source of the driving TFT, and a source for receiving a data voltage signal;

a third TFT having a gate for receiving a second scan signal, a source connected to a drain of the driving TFT, and a drain connected to the light-emitting element;

a fourth TFT having a gate for receiving the first scan signal, a source connected to the gate of the driving TFT, and a drain connected to a first electrode of the driving TFT, wherein the first electrode of the driving TFT is drain or the source of the driving TFT;

a fifth TFT having a gate for receiving the second scan signal, a source connected to a power supply voltage terminal, and a drain connected to the source of the driving TFT;

a capacitor having one terminal connected to a first node A, and the other terminal connected to a second node B, wherein the first node A is a connection point where the drain of the first TFT is connected to the gate of the driving TFT, and the second node B is connected to the reference voltage terminal;

wherein the reference voltage terminal keeps its voltage unchanged.

2. The pixel circuit of claim 1, wherein the first TFT, the second TFT, the third TFT, the fourth TFT, and the fifth TFT and the driving TFT are all P type thin Film Transistors, and the first electrode of the driving TFT is the drain of the driving TFT.

3. The pixel circuit of claim 2, wherein the power supply voltage terminal supplies a positive power supply voltage, the positive power supply voltage is higher than a reference voltage at the reference voltage terminal, and a data voltage of the data voltage signal is lower than the positive power supply voltage.

4. The pixel circuit of claim 2, wherein an anode of the light-emitting element is connected to the drain of the third TFT, and a cathode of the light-emitting element is connected to the reference voltage terminal.

5. A display device having the pixel circuit of claim 1 arranged therein.

6. The display device of claim 5, wherein the first TFT, the second TFT, the third TFT, the fourth TFT, and the fifth TFT and the driving TFT are all P type Thin Film Transistors, and the first electrode of the driving TFT is the drain of the driving TFT;

the power supply voltage terminal supplies a positive power supply voltage, the positive power supply voltage is higher than a reference voltage at the reference voltage terminal, and a data voltage of the data voltage signal is lower than the positive power supply voltage.

7. The display device of claim 6, wherein, in the pixel unit, an anode of the light-emitting element is connected to the drain of the third TFT, and a cathode of the light-emitting element is connected to the reference voltage terminal.

8. A method for driving a pixel circuit, the pixel circuit comprising:

a light-emitting element;

a driving Thin Film Transistor TFT for driving the light-emitting element;

a first TFT having a source connected to a reference voltage terminal, a drain connected to a gate of the driving TFT, and a gate for receiving a first control signal;

a second TFT having a gate for receiving a first scan signal, a drain connected to a source of the driving TFT, and a source for receiving a data voltage signal;

a third TFT having a gate for receiving a second scan signal, a source connected to a drain of the driving TFT, and a drain connected to the light-emitting element;

a fourth TFT having a gate for receiving the first scan signal, a source connected to the gate of the driving TFT, and a drain connected to a first electrode of the driving TFT, wherein the first electrode of the driving TFT is the drain or the source of the driving TFT;

a fifth TFT having a gate for receiving the second scan signal, a source connected to a power supply voltage terminal, and a drain connected to the source of the driving TFT;

a capacitor having one terminal connected to a first node A, and the other terminal connected to a second node B, wherein the first node A is a connection point where the drain of the first TFT is connected to the gate of the driving TFT, and the second node B is connected to the reference voltage terminal, the method comprising:

in a resetting phase, turning on the first TFT under a control of a first control signal, discharging electric charges stored at the first node via the first TFT, resetting a voltage signal at the gate of the driving TFT so as turn on the driving TFT, and turning off the second TFT, the third TFT, the fourth TFT and the fifth TFT;

in a compensating phase, turning on the second TFT and the fourth TFT under a control of a first scan signal, making the driving TFT continue to be turned on, wherein since the fourth TFT is turned on, the gate and the drain of the driving TFT are connected electrically; charging the first node by a data signal via the driving TFT, so that a voltage at the node rises; and turning off the first TFT, the third TFT and the fifth TFT; and in a maintaining light-emission phase, turning on the third TFT and the fifth TFT under a control of a second scan signal, keeping the voltage at the gate of the driving TFT unchanged by the capacitor, and making the driving TFT continue to be turned on, and driving the OLED to emit light by a power supply voltage; and turning off the first TFT, the second TFT and the fourth TFT.

9. The method of claim 8, wherein the first TFT, the second TFT, the third TFT, the fourth TFT, and the fifth TFT and the driving TFT are all P type Thin Film Transistors, and the first electrode of the driving TFT is the drain of the driving TFT;

the power supply voltage terminal supplies a positive power supply voltage, the positive power supply voltage is higher than a reference voltage at the reference voltage terminal, and a data voltage of the data voltage signal is lower than the positive power supply voltage.

10. The method of claim 9, wherein, in the pixel circuit, an anode of the light-emitting element is connected to the drain of the third TFT, and a cathode of the light-emitting element is connected to the reference voltage terminal.

* * * * *